US010149043B2

(12) United States Patent
Liu et al.

(10) Patent No.: US 10,149,043 B2
(45) Date of Patent: Dec. 4, 2018

(54) AMPLIFIER AND ELECTRONIC DEVICE USING THE SAME

(71) Applicant: Acer Incorporated, New Taipei (TW)

(72) Inventors: Feng-Ming Liu, New Taipei (TW); Jia-Ren Chang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 15/418,905

(22) Filed: Jan. 30, 2017

(65) Prior Publication Data

US 2018/0014114 A1 Jan. 11, 2018

(30) Foreign Application Priority Data

Jul. 11, 2016 (TW) ..... 105121703 A

(51) Int. Cl.

*H04R 1/02* (2006.01)
*H04R 1/28* (2006.01)
*H04R 3/00* (2006.01)

(52) U.S. Cl.

CPC ..... *H04R 1/2857* (2013.01); *H04R 1/025* (2013.01); *H04R 3/00* (2013.01); *H04R 2201/028* (2013.01)

(58) Field of Classification Search

CPC ..... H04R 1/02; H04R 1/021; H04R 1/025; H04R 1/28; H04R 1/288; H04R 1/345; H04R 1/2803; H04R 1/2811; H04R 1/2826; H04R 1/2087; H04R 1/2834; H04R 1/2849; H04R 1/2857; H04R 3/00; H04R 2201/028; H04R 5/00; H04R 5/02; H04R 2499/15

See application file for complete search history.

(56) References Cited

U.S. PATENT DOCUMENTS 4,953,655 A * 9/1990 Furukawa ..... H04R 1/2819 181/156
5,189,706 A * 2/1993 Saeki ..... H04R 1/2826 181/155
5,471,019 A * 11/1995 Maire ..... H04R 1/2842 181/156
5,805,708 A * 9/1998 Freadman ..... G06F 1/1616 181/182
7,136,498 B1 * 11/2006 Schott ..... H04R 1/2842 381/351
2002/0051552 A1 * 5/2002 Schott ..... H04R 1/2842 381/345

(Continued)

FOREIGN PATENT DOCUMENTS

CN 2629377 Y 7/2004
CN 201946293 U 8/2011

(Continued)

*Primary Examiner* — Thang V Tran

(74) *Attorney, Agent, or Firm* — McClure, Qualey & Rodack, LLP

(57) ABSTRACT

An amplifier and an electronic device using the same are provided. The amplifier includes a first acoustic box, a speaker, a second acoustic box, a connection tube and at least one sound guide tube. The first acoustic box has a first sound hole. The speaker faces the first acoustic box. The second acoustic box has at least one second sound hole. The connection tube connects the first acoustic box and the second acoustic box. The sound guide tube is connected to the second sound hole.

16 Claims, 6 Drawing Sheets

(56) References Cited

U.S. PATENT DOCUMENTS

| | | | | |
|---|---|---|---|---|
| 2007/0195984 | A1* | 8/2007 | Yang | H04R 1/1075<br>381/372 |
| 2011/0228958 | A1* | 9/2011 | Gelbart | H04R 1/345<br>381/182 |
| 2013/0114844 | A1* | 5/2013 | Fukazawa | H04M 1/035<br>381/387 |
| 2014/0004909 | A1* | 1/2014 | Jiang | H04M 19/04<br>455/567 |
| 2017/0041705 | A1* | 2/2017 | Liu | H04R 1/345 |

FOREIGN PATENT DOCUMENTS

| | | | |
|---|---|---|---|
| CN | 203104578 | U | 7/2013 |
| TW | M366261 | U1 | 10/2009 |

* cited by examiner

AMPLIFIER AND ELECTRONIC DEVICE USING THE SAME

This application claims the benefit of Taiwan application Serial No. 105121703, filed Jul. 11, 2016, the subject matter of which is incorporated herein by reference.

BACKGROUND OF THE INVENTION

Field of the Invention

The invention relates in general to an amplifier and an electronic device using the same, and more particularly to an amplifier using more than two speakers and an electronic device using the same.

Description of the Related Art

Along with the development in technology, new electronic devices are provided one after another. Many portable electronic devices are equipped with an amplifier for playing music or sound effects. In response to users' requirements of portability of electronic devices, the amplifier may adopt laterally sounding design.

However, it is found that when the amplifier adopts laterally sounding design, the timbre is dull and the sound is monotonous, therefore the played music lacks harmony and softness.

SUMMARY OF THE INVENTION

The invention relates to an amplifier and an electronic device using the same capable of generating overtone through additionally added acoustic box and sound guide tube to improve the harmony and softness of the timbre.

According to one embodiment of the present invention, an amplifier is provided. The amplifier includes a first acoustic box, a speaker, a second acoustic box, a connection tube and at least one sound guide tube. The first acoustic box has a first sound hole. The speaker faces the first acoustic box. The second acoustic box has at least one second sound hole. The connection tube connects the first acoustic box and the second acoustic box. The sound guide tube is connected to the second sound hole.

According to another embodiment of the present invention, an electronic device is provided. The electronic device includes an amplifier and an audio processing circuit. The amplifier includes a first acoustic box, a speaker, a second acoustic box, a connection tube and at least one sound guide tube. The first acoustic box has a first sound hole. The speaker faces the first acoustic box. The second acoustic box has at least one second sound hole. The connection tube connects the first acoustic box and the second acoustic box. The sound guide tube is connected to the second sound hole. The audio processing circuit provides an audio signal to the amplifier.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
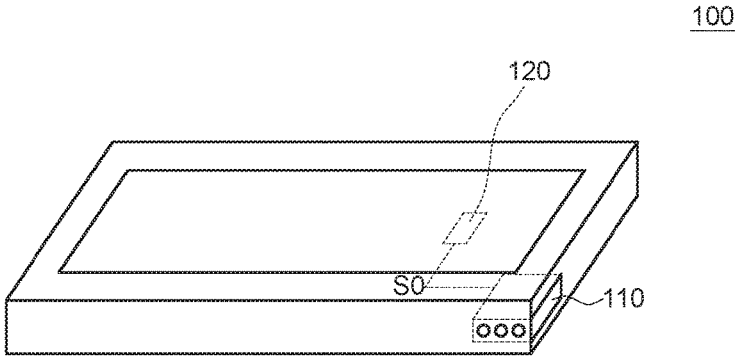
FIG. 1 is a schematic diagram of an electronic device according to an embodiment of the invention.

Referring to FIG. 1, a schematic diagram of an electronic device 100 according to an embodiment of the invention is shown. The electronic device 100 can be realized by such as a tablet PC, a laptop, a smartphone, or a portable audio and video device. The electronic device 100 includes an amplifier 110 and an audio processing circuit 120. The audio processing circuit 120 provides an audio signal S0 to the amplifier 110.

To comply with the miniaturization and thinness design of the electronic device 100, the amplifier 110 may need to adopt laterally sounding design. When the amplifier 110 adopts laterally sounding design, the timbre is dull and the sound is monotonous, therefore the played music lacks harmony and softness. According to the laterally sounding design, the sound hole is located at a lateral side rather than the right front of the speaker. In the present embodiment, overtone design is used in the amplifier 110 to enrich the harmony and softness of the timbre.

Figure 2:
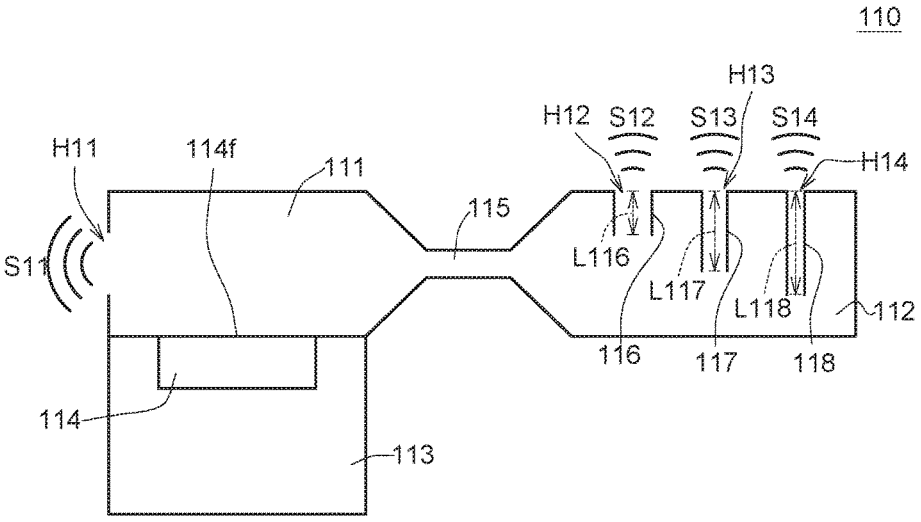
FIG. 2 is a side view of the amplifier of FIG. 1.
Figure 3:
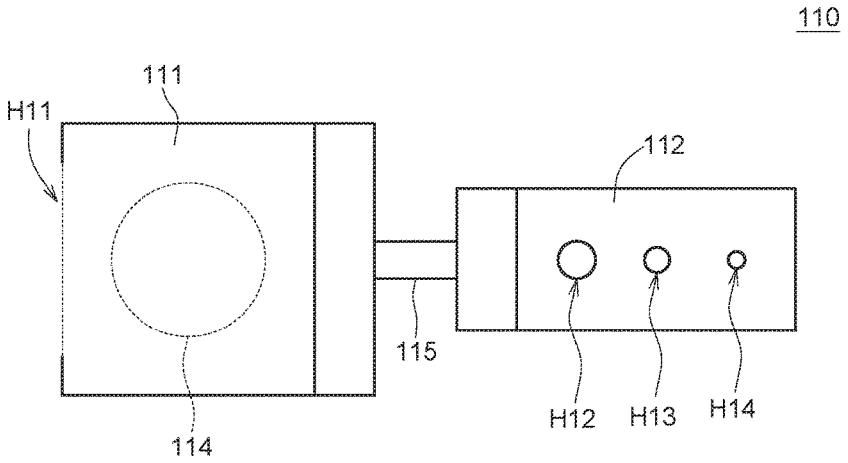
FIG. 3 is a top view of the amplifier of FIG. 1.

Refer to FIG. 2 and FIG. 3. FIG. 2 is a side view of the amplifier 110 of FIG. 1. FIG. 3 is a top view of the amplifier 110 of FIG. 1. The amplifier 110 includes a first acoustic box 111, a second acoustic box 112, a third acoustic box 113, a speaker 114, a connection tube 115 and at least one sound guide tube, such as sound guide tubes 116 to 118. Each of the first acoustic box 111 and the second acoustic box 112 is an open-type acoustic box, and the third acoustic box 113 is a closed-type acoustic box. In an embodiment, the amplifier 110 may exclude the third acoustic box 113. The first acoustic box 111 has a first sound hole H11 located on a lateral side of the first acoustic box 111. The first sound hole H11 is for radiating a keynote S11.

The speaker 114 is disposed in the third acoustic box 113, and faces the first acoustic box 111. The vibration film 114*f* of the speaker 114 is located at the junction between the first acoustic box 111 and the third acoustic box 113.

The connection tube 115 connects the first acoustic box 111 and the second acoustic box 112. The connection tube 115 and the first sound hole H11 are located on two opposite sides of the first acoustic box 111. The cross-sectional area of the connection tube 115 is smaller than the area of the first sound hole H11. The cross-sectional area of the connection tube 115 is smaller than the cross-sectional area of the first acoustic box 111, and the cross-sectional area of the connection tube 115 is smaller than the cross-sectional area of the second acoustic box 112, such that the first acoustic box 111 and the second acoustic box 112 form two independent sound chambers. In the present embodiment, the volume of the first acoustic box 111 is larger than the volume of the second acoustic box 112. In another embodiment, the volume of the first acoustic box 111 can be smaller than or is equivalent to the volume of the second acoustic box 112.

The second acoustic box 112 has at least one second sound hole, such as second sound holes H12 to H14. The sound guide tube 116 is connected to the second sound hole H12, and is disposed in the second acoustic box 112. The cross-sectional area of the sound guide tube 116 is equivalent to the area of the second sound hole H12. The second sound hole H12 is for radiating an overtone S12.

The sound guide tube 117 is connected to the second sound hole H13, and is disposed in the second acoustic box 112. The cross-sectional area of the sound guide tube 117 is equivalent to the area of the second sound hole H13. The second sound hole H13 is for radiating an overtone S13.

The sound guide tube 118 is connected to the second sound hole H14, and is disposed in the second acoustic box 112. The cross-sectional area of the sound guide tube 118 is equivalent to the area of the second sound hole H14. The second sound hole H14 is for radiating an overtone S14.

In the present embodiment, the lengths L116 to L118 of the sound guide tubes 116 to 118 are not the same, such that the overtones S12 to S14 have different frequencies. For example, the farther away from the connection tube 115 the sound guide tubes 116 to 118, the longer the sound guide tubes 116 to 118. That is, the length L116 of the sound guide tube 116 is smaller than the length L117 of the sound guide tube 117, and the length L117 of the sound guide tube 117 is smaller than the length L118 of the sound guide tube 118.

The sound guide tubes 116 to 118 all have an even cross-section for smoothly guiding the airflow to the second sound holes H12 to H14.

Based on the Helmholtz theory, the second acoustic box 112 and the sound guide tube 116 (or the sound guide tube 117, 118) can generate an overtone S12 (or an overtone S13, S14) with a specific frequency. Refer to formula (1). The structural design of the second acoustic box 112 and the sound guide tube 116 (or the sound guide tube 117, 118) can be arranged according to formula (1):

$$f = \frac{V_s}{2\pi}\sqrt{\frac{A}{VL}} \tag{1}$$

Wherein, f denotes frequency, $V_s$ denotes the propagation velocity of the sound wave, π denotes circumference rate, A denotes the cross-sectional area of the sound guide tube 116 (or the cross-sectional area of the sound guide tube 117, 118), V denotes the total volume of the second acoustic box 112, L denotes the length L116 of the sound guide tube 116 (or the length L117, L118 of the sound guide tube 117, 118).

That is, for the amplifier 110 to provide the overtone S12 (or the overtone S13, S14) with a specific frequency, the length of the sound guide tube 116 (or the length of the sound guide tube 117, 118) is designed to have negative correlation with the frequency of the overtone S12 (or the frequency of the overtone S13, S14), the cross-sectional area of the sound guide tube 116 (or the cross-sectional area of the sound guide tube 117, 118) is designed to have positive correlation with the frequency of the overtone S12 (or the frequency of the overtone S13, S14), and the volume of the second acoustic box 112 is designed to have negative correlation with the frequency of the overtone S12 (or the frequency of the overtone S13, S14).

In other words, to achieve the desired frequency of the overtone S12 (or the desired frequency of the overtone S13, S14), structural design regarding the length of the sound guide tube 116 (or the length of the sound guide tube 117, 118), the cross-sectional area of the sound guide tube 116 (or the cross-sectional area of the sound guide tube 117, 118) and the volume of the second acoustic box 112 can be arranged according to formula (2):

$$\frac{A}{VL} = \frac{f^2 v_s^2}{4\pi^2} \tag{2}$$

Structural design of the length of the sound guide tube 116 (or the length of the sound guide tube 117, 118) can be arranged according to formula (3):

$$L = \frac{4\pi^2 A}{f^2 v_s^2 V} \tag{3}$$

Structural design of the cross-sectional area of the sound guide tube 116 (or the cross-sectional area of the sound guide tube 117, 118) and the volume of the second acoustic box 112 can be arranged according to formula (4):

$$A = \frac{f^2 v_s^2 VL}{4\pi^2} \tag{4}$$

Structural design of the volume of the second acoustic box 112 can be arranged according to formula (5).

$$V = \frac{4\pi^2 A}{f^2 v_s^2 L} \tag{5}$$

According to the design exemplified in above embodiments, the second acoustic box 112 is equipped with three sound guide tubes 116 to 118 and three second sound holes H12 to H14 to form three overtones S12 to S14. In another embodiment, the second acoustic box 112 can be equipped with only one sound guide tube and only one second sound hole to form an overtone. The experimental results show that, one overtone can increase the harmony and softness of the timbre effectively.

In another embodiment, the second acoustic box 112 can be equipped with more than three sound guide tubes and more than three second sound holes to form more than three overtones as long as the quantity of sound guide tubes is equivalent to the quantity of second sound holes, and each sound guide tube is connected to a corresponding second sound hole.

Figure 4:
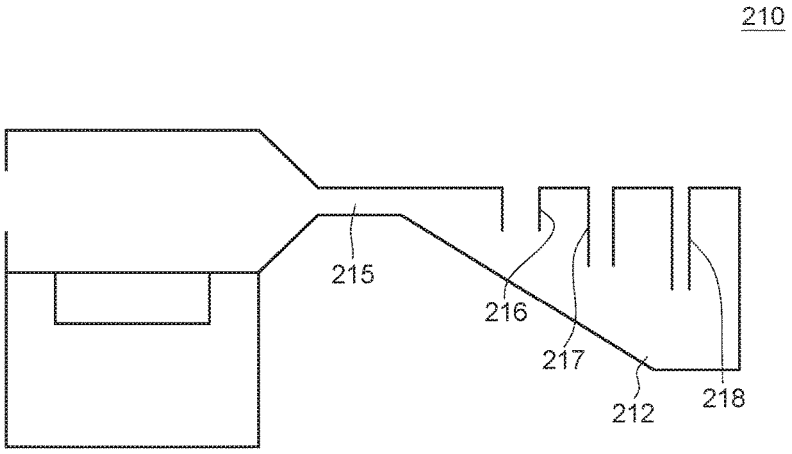
FIG. 4 is a schematic diagram of an amplifier according to another embodiment.

Referring to FIG. 4, a schematic diagram of an amplifier 210 according to another embodiment is shown. In the present embodiment, the lateral side of the second acoustic box 212 is a trapezoidal structure. The second acoustic box 212 gradually expands in a direction away from the connection tube 215 to accommodate the sound guide tubes 216 to 218. In other embodiment, the second acoustic box (not illustrated) can gradually shrink in a direction away from the connection tube (not illustrated).

Figure 5:
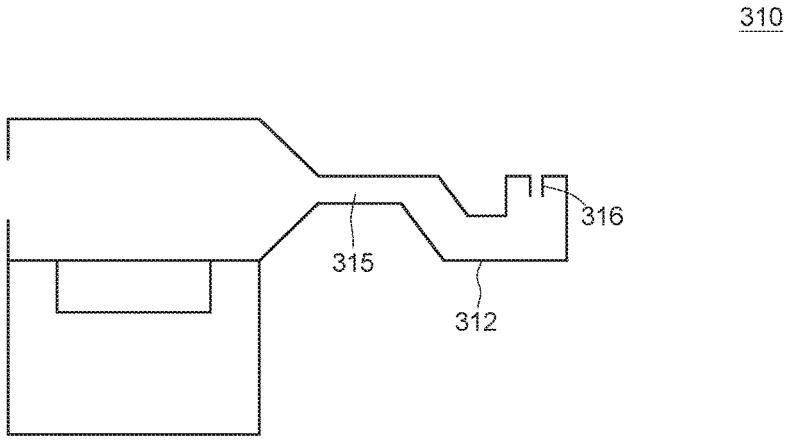
FIG. 5 is a schematic diagram of an amplifier according to another embodiment.

Referring to FIG. 5, a schematic diagram of an amplifier 310 according to another embodiment is shown. In the present embodiment, the second acoustic box 312 can have a bent tubed structure. The cross-sectional area of the second acoustic box 312 having the bent tubed structure is larger than that of the connection tube 315, such that the second acoustic box 312 still can form an independent sound chamber. The cross-sectional area of the sound guide tube 316 is smaller than that of the second acoustic box 312 having the bent tubed structure, such that the sound guide tube 316 can be disposed in the second acoustic box 312.

Figure 6:
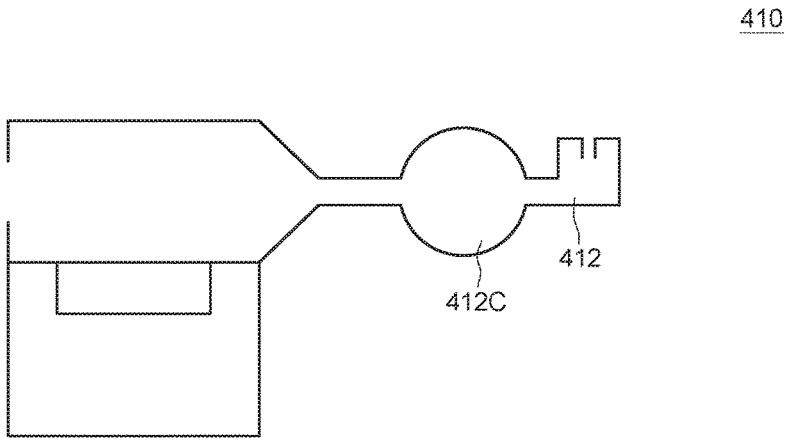
FIG. 6 is a schematic diagram of an amplifier according to another embodiment.

Referring to FIG. 6, a schematic diagram of an amplifier 410 according to another embodiment is shown. In the present embodiment, the second acoustic box 412 can include a spherical structure 412C for providing a resonance space for the sound wave.

Figure 7:
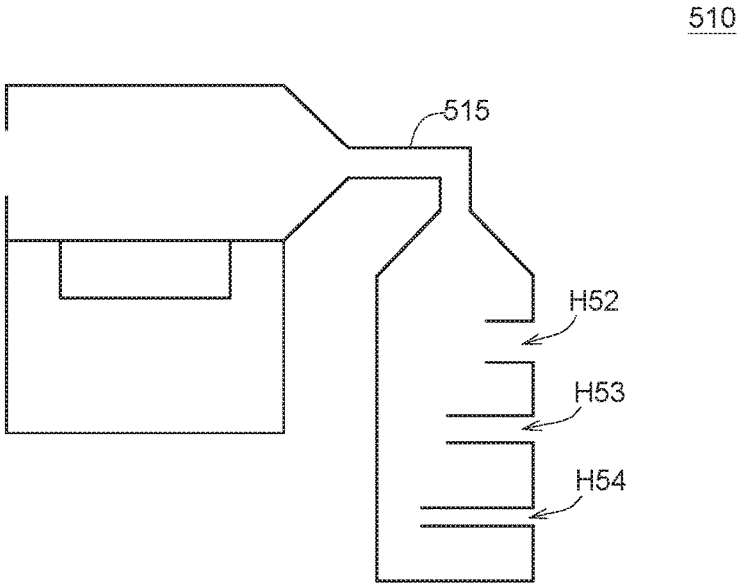
FIG. 7 is a schematic diagram of an amplifier according to another embodiment.

Referring to FIG. 7, a schematic diagram of an amplifier 510 according to another embodiment is shown. In the present embodiment, the connection tube 515 can have a bent structure for changing the direction of the second sound holes H52 to H54. In other embodiment, the connection tube (not illustrated) can have more than one bends, such that the second sound hole (not illustrated) can face another direction.

Figure 8:
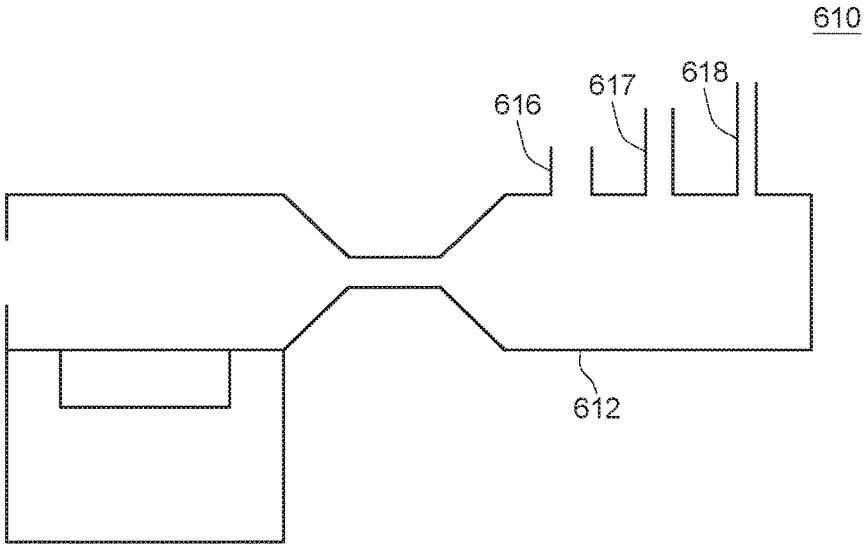
FIG. 8 is a schematic diagram of an amplifier according to another embodiment.

Referring to FIG. 8, a schematic diagram of an amplifier 610 according to another embodiment is shown. In the present embodiment, the sound guide tubes 616 to 618 can be disposed outside the second acoustic box 612 to reduce the airflow interference generated in the second acoustic box 612 by the sound guide tubes 616 to 618. In other embodiment, some of the sound guide tubes (not illustrated) can be disposed in the second acoustic box (not illustrated), and the remaining sound guide tubes (not illustrated) can be disposed in the second acoustic box (not illustrated).

Figure 9:
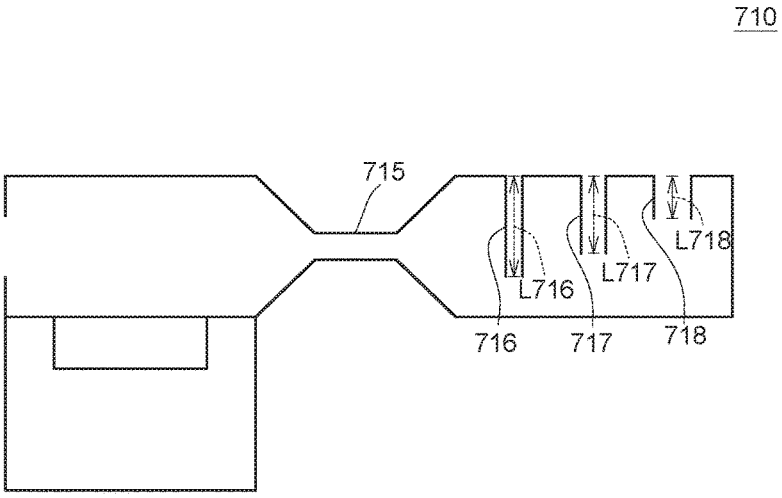
FIG. 9 is a schematic diagram of an amplifier according to another embodiment.

Referring to FIG. 9, a schematic diagram of an amplifier 710 according to another embodiment is shown. In the present embodiment, the farther away from the connection tube 715 the sound guide tubes 716 to 718, the shorter the sound guide tubes. That is, the length L716 of the sound guide tube 716 is larger than the length L717 of the sound guide tube 717, and the length L717 of the sound guide tube 717 is larger than the length L718 of the sound guide tube 718.

Figure 10:
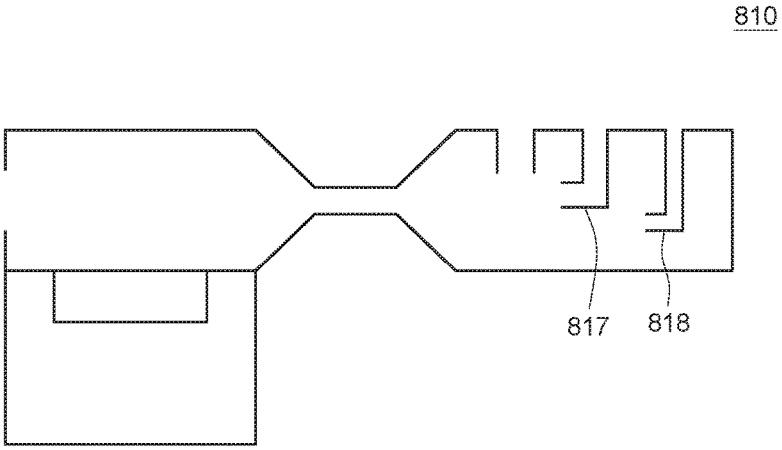
FIG. 10 is a schematic diagram of an amplifier according to another embodiment.

Referring to FIG. 10, a schematic diagram of an amplifier 810 according to another embodiment is shown. In the present embodiment, each of the sound guide tube 817 and the sound guide tube 818 can have a bent structure and is not limited to a straight tubed structure. In other embodiment, the sound guide tube (not illustrated) can have more than one bend.

Figure 11:
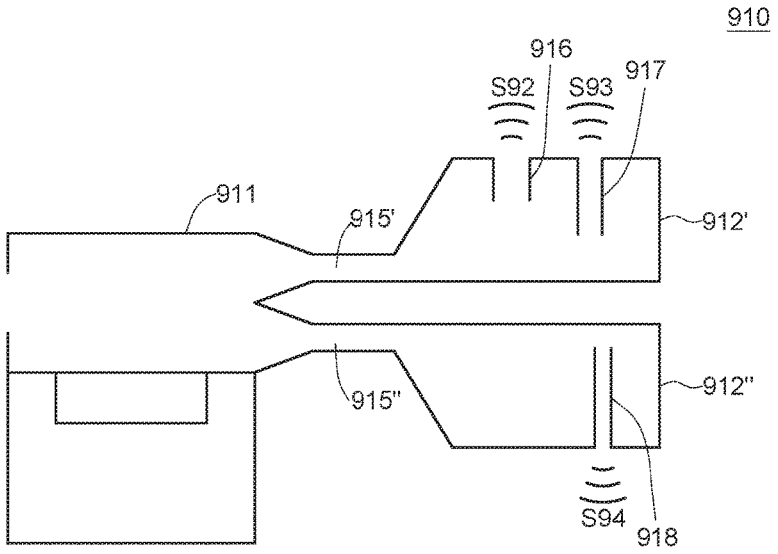
FIG. 11 is a schematic diagram of an amplifier according to another embodiment.

Referring to FIG. 11, a schematic diagram of an amplifier 910 according to another embodiment is shown. In the present embodiment, the amplifier 910 has two connection tubes 915' and 915" and two second acoustic boxes 912' and 912". The connection tube 915' connects the first acoustic box 911 and the second acoustic box 912'. The connection tube 915" connects the first acoustic box 911 and the second acoustic box 912". The sound guide tube 916 and the sound guide tube 917 are disposed in the second acoustic box 912'. The sound guide tube 918 is disposed in the second acoustic box 912". Thus, the second acoustic boxes 912' and 912" having different sizes can make the overtone S94 have larger frequency difference with the overtones S92 and S93.

According to each of the embodiments disclosed above, when the amplifier adopts laterally sounding design, the design of additionally adding acoustic box and sound guide tube can generate an overtone to improve the harmony and softness of the timbre.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An amplifier, comprising:

a first acoustic box having a first sound hole;

a speaker facing the first acoustic box;

a second acoustic box having at least one second sound hole;

a connection tube connecting the first acoustic box and the second acoustic box, wherein a radiating direction of the first sound hole is parallel to an extending direction of a length of the connection tube; and at least one sound guide tube connected to the at least one second sound hole;

wherein the sound guide tube extends toward the inside of the second acoustic box, and there is a space between the sound guide tube and the second acoustic box, the space surrounds the sound guide tube, wherein the first sound hole is arranged on a side surface of the first acoustic box, and the first sound hole and the connection tube are disposed on two opposite side surfaces of the first acoustic box.

2. The amplifier according to claim 1, wherein the sound guide tube is disposed in the second acoustic box.

3. The amplifier according to claim 1, wherein a quantity of the at least one second sound hole is pleural, a quantity of the at least one sound guide tube is pleural, and each of the sound guide tubes is connected to one of the second sound holes.

4. The amplifier according to claim 3, wherein the sound guide tubes have different lengths.

5. The amplifier according to claim 1, further comprising:

a third acoustic box, wherein the speaker is disposed in the third acoustic box, the third acoustic box is a closed-type acoustic box, and each of the first acoustic box and the second acoustic box is an open-type acoustic box.

6. The amplifier according to claim 1, wherein a cross-sectional area of the connection tube is smaller than a cross-sectional area of the first acoustic box, and a cross-sectional area of the connection tube is smaller than s cross-sectional area of the second acoustic box.

7. The amplifier according to claim 1, wherein a cross-sectional area of the at least one sound guide tube is equivalent to an area of the at least one second sound hole.

8. The amplifier according to claim 1, wherein a volume of the first acoustic box is larger than a volume of the second acoustic box.

9. An electronic device, comprising:

an amplifier, comprising:

a first acoustic box having a first sound hole a speaker facing the first acoustic box;

a second acoustic box having at least one second sound hole;

a connection tube connecting the first acoustic box and the second acoustic box, wherein a radiating direction of the first sound hole is parallel to an extending direction of a length of the connection tube; and at least one sound guide tube connected to the at least one second sound hole, wherein the sound guide tube extends toward the inside of the second acoustic box, and there is a space between the sound guide tube and the second acoustic box, the space surrounds the sound guide tube, and wherein the first sound hole is arranged on a side surface of the first acoustic box, and the first sound hole and the connection tube are disposed on two opposite side surfaces of the first acoustic box; and an audio processing circuit for providing an audio signal to the amplifier.

10. The electronic device according to claim 9, wherein the sound guide tube is disposed in the second acoustic box.

11. The am electronic device according to claim 9, wherein a quantity of the at least one second sound hole is pleural, a quantity of the at least one sound guide tube is pleural, and each of the sound guide tubes is connected to one of the second sound holes.

12. The electronic device according to claim 11, wherein the sound guide tubes have different lengths.

13. The electronic device according to claim 9, wherein the amplifier further comprises a third acoustic box, the speaker is disposed in the third acoustic box, the third acoustic box is a closed-type acoustic box, and each of the first acoustic box and the second acoustic box is an open-type acoustic box.

14. The electronic device according to claim 9, wherein a cross-sectional area of the connection tube is smaller than a cross-sectional area of the first acoustic box, and a cross-sectional area of the connection tube is smaller than s cross-sectional area of the second acoustic box.

15. The electronic device according to claim 9, wherein a cross-sectional area of the at least one sound guide tube is equivalent to an area of the at least one second sound hole.

16. The electronic device according to claim 9, wherein a volume of the first acoustic box is larger than a volume of the second acoustic box.

* * * * *